US006575530B1

(12) United States Patent
Fischer et al.

(10) Patent No.: US 6,575,530 B1
(45) Date of Patent: Jun. 10, 2003

(54) DEVICE FOR LUMBAR SUPPORT

(75) Inventors: Harry Fischer, Degernau (DE); Klaus-Peter Grasse, Waldshut (DE); Manfred Schlegel, Kuessaberg (DE); Mathias Seiler, Loerrach (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 10/137,335

(22) Filed: May 3, 2002

(51) Int. Cl.[7] ..... A47C 3/025

(52) U.S. Cl. ..... 297/284.4; 297/284.1; 297/284.7; 297/284.8

(58) Field of Search ..... 297/284.1, 284.2, 297/284.4, 284.7, 284.8

(56) References Cited

U.S. PATENT DOCUMENTS 6,354,662 B1 * 3/2002 Su
6,394,546 B1 * 5/2002 Knoblock et al.
6,471,294 B1 * 10/2002 Dammermann et al.

FOREIGN PATENT DOCUMENTS

DE 299 18 456 U 1 1/2000
DE 198 56 349 A 1 6/2000
FR 2556197 * 6/1985
WO WO 92/21269 * 12/1992

* cited by examiner

*Primary Examiner*—Laurie K. Cranmer
(74) *Attorney, Agent, or Firm*—Oblon, Spivak, McClelland, Maier & Neustadt, P.C.

(57) ABSTRACT

A device for lumbar support for an office chair having a seatback including a seatback frame and a membrane stretched over the seatback frame. The device can be arranged behind the membrane and can be housed in the seatback frame to provide vertical and horizontal adjustment independent of the membrane. Preferably, the device includes a central part having two comparably rigid carrier elements connected to each other via an elastic element arranged therebetween, the rigid carrier elements each including a guide track that can be arranged in the seatback frame to provide the vertical adjustment. A front part includes a cushion attached to an upholstery plate, the upholstery plate facing the membrane. A rear part includes a plastic plate. The cushion and the plastic plate are connected via a clip connection, and the clip connection is guided in slots of the carrier elements.

8 Claims, 1 Drawing Sheet

DEVICE FOR LUMBAR SUPPORT

TECHNICAL FIELD

Figure 1:
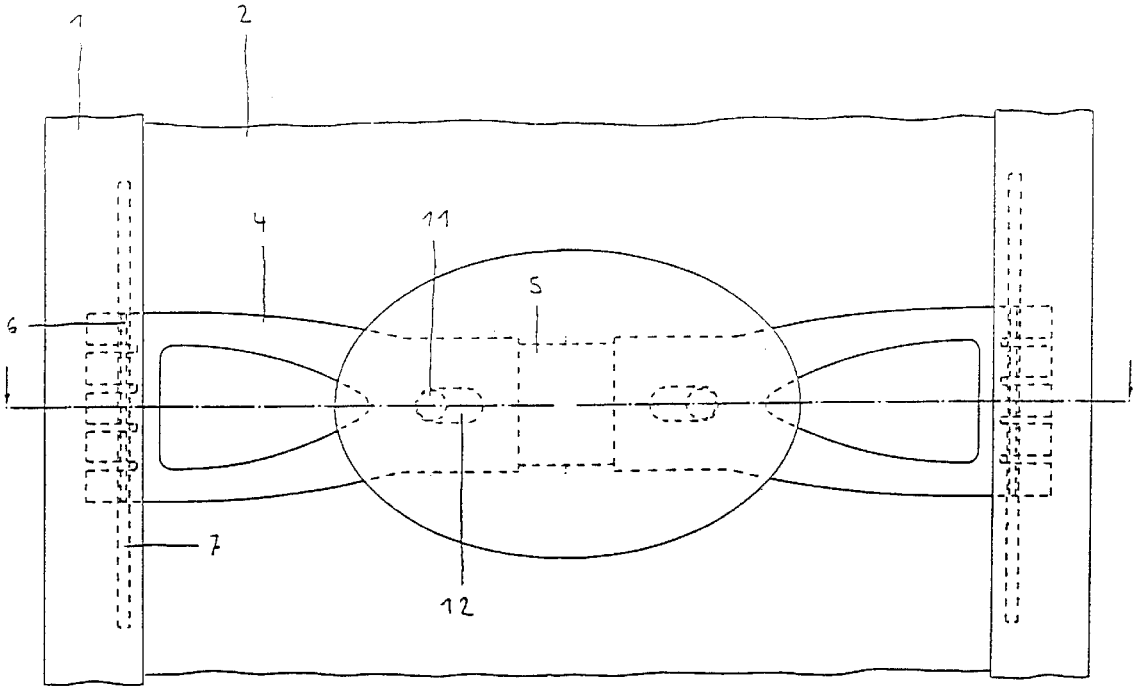

The present invention relates to the field of the furniture industry. It concerns a device for lumbar support for an office swivel chair whose back of the seat is formed of a seatback frame having a membrane stretched over it.

RELATED ART

These days people complain increasingly about back pain. Because of less movement and greater mental stress, such as constant stress, the motive apparatus becomes sluggish and atrophies, the muscles become fatigued and cramped, and circulation in tissue and organs becomes poor. Often the spinal column, as a sensitive and heavily stressed body part, must pay this price with pains and problems.

One seeks to counteract this, for example, by using special devices for lumbar support, such as lumbar pads, which are integrated into the seatback of office chairs. The curvature of the spinal column to the front (hollow back) is characterized as lordosis. The device for lumbar support is expected to fill in the hollow area in this case as precisely as possible.

Known are effective lumbar supports that are used in chairs having an additional seatback pad are (e.g. New York model of the applicant).

However, the currently known solutions for office chairs having a seatback with membrane covers without a seatback pillow are unsatisfactory.

On the one hand, these known devices for lumbar support on office chairs having a seatback with a membrane cover press in part uncomfortably against the user, even if they are soft or padded, as is the case, for example, with the Aeron model of the Herman Miller Company. In that case, a height adjustable lumbar pad is used with two guiding slots in the seatback frame.

On the other hand, the chairs having a seatback with a membrane cover, there are also earlier models having support devices that lead only to a barely noticeable lumbar support, e.g., Wilkhahn Modus and Vitra Meda Chair 2.

This unsatisfactory earlier state of the art results from the following problem: A back rest padded with foam permits placing a plastic element between the upholstery plate and the foam material that can be adjusted in height to suit the individual and which bows the pad forward to the position at which it supports the lumbar area of the user in question The pad itself ensures that the plastic element does not create pressure. Finally, the plastic element is upholstered just like the rest of the seatback. The pad substantially balances the structure.

A seatback having a membrane stretched over it without a pad structure, by contrast, does not show any upholstery covering the plastic element. Therefore, a device for lumbar support arranged behind or in front of the membrane and permanently inserted in the seatback frame independent of the membrane presses uncomfortably into the back, even if it is soft or padded.

If, by contrast, the lumbar support is not inserted in the seatback, but is inserted directly in the membrane, then it will move back along with the membrane and is, therefore, nearly without effect as a rule regarding relief of stress on the spinal column.

ILLUSTRATION OF THE INVENTION

The present invention attempts to avoid the cited disadvantages of the known state of the art. It is based on the objective of developing a device for lumbar support for an office chair having a back rest that is formed of a seatback frame with a membrane stretched over it, the lumbar support being easily adjustable in height, not putting pressure on the user of the chair and at the same time supporting the lumbar area in a manner effective for the individual.

According to the invention, this objective is achieved by a device for lumbar support for an office chair according to the definition of the preamble to claim 1, wherein the device is adjustable in height and is also horizontally extendable. The lumbar pad position adjustment is embedded in the seatback frame independently of the membrane, but has sufficient elasticity for the pad not to create pressure. It is appropriate that the device consist of the following parts:

a) A central component having two comparatively rigid carrier elements that are connected to each other via an elastic element arranged in the center and each of which has on the outside a lateral guide stem, wherein the guide stems being arranged in the seatback frame and has a sliding adjustment, b) a cushion pad as a front part arranged facing the membrane and fastened to an upholstery plate, as well as c) a plastic plate as a back part, whereby d) the cushion and the plastic plate, are connected via a clip connection and the clip connection is controlled in the guiding slots of the carrier elements.

Furthermore, it is practical if the elastic element is a rubber strap. This yields under a load sufficiently enough and effects the extension of the carrier elements so that the device, in particular the upholstery pillow, moves rearward. Consequently, there is no unduly high counter-pressure.

Additionally, it has its advantages, wherein the guiding frame of the carrier elements are each located in a guiding slot of the seatback frame, and/or on a guiding frame of the seatback frame. In this way, a simple guide and height adjustment of the device for lumbar-support is possible. That results in an exact tracking of the pad corresponding to the membrane.

SHORT DESCRIPTION OF DRAWINGS

Figure 2:
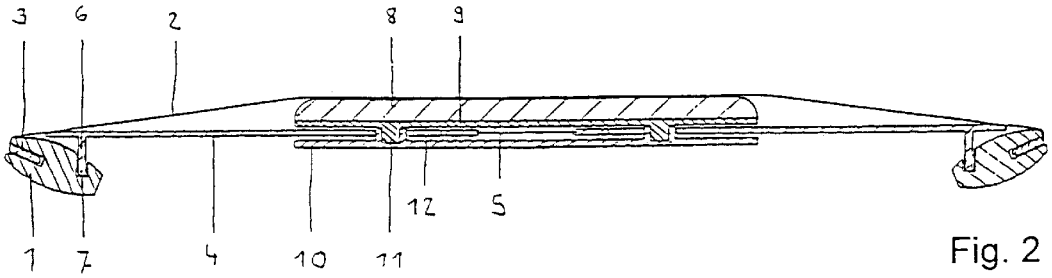
Figure 3:
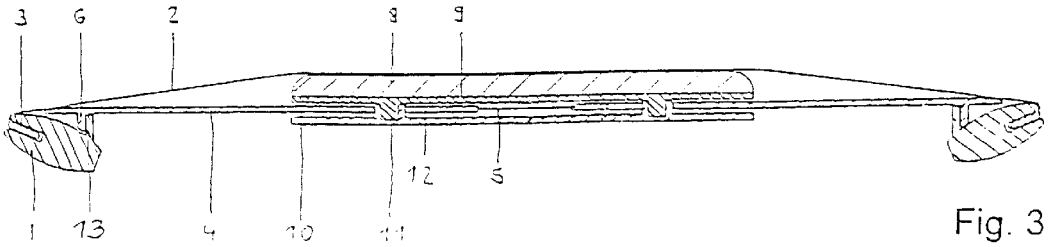

Two design examples of the invention are depicted in the drawing. Shown are:

FIG. 1 A top view of the seatback frame of the chair with a membrane covered seatback device embedded according to the first design variation;

FIG. 2 a section view of the device according to the invention along the line II—II in FIG. 1;

FIG. 3 a section view analogous to FIG. 2 in a second design variation of the invention.

Only the elements essential for understanding the invention are shown. The same elements in the various figures are provided with the same reference numbers for each.

WAYS OF IMPLEMENTING THE INVENTION

In the following, the invention is explained in further detail with respect to the two design examples and FIGS. 1 through 3.

FIG. 1 shows a top view of the seatback framer (1) of an office chair having a seat back covered with a membrane embedded device in accordance with the invention in the first design model. FIG. 2 shows the corresponding section view along line II—II.

The seatback of the chair consists of a seatback flame 1, which has a membrane 2 stretched over it. Membrane 2 is fastened in seatback frame 1 by membrane piping 3. The lumbar support device of the present invention is arranged behind membrane 2 and embedded in seatback frame I independently from membrane 2.

It is consists essentially of three parts, specifically, of a front-side part, i.e. a front part arranged facing membrane 2 that is formed of a cushion 8 fastened on an upholstery plate 9 and a back part consisting of a plastic plate 10 and a central part arranged between them. The central part has two relatively rigid carrier elements 4 made of plastic that are attached to each other in the center via a rubber strap 5. Carrier elements 4 have a slot 12 on each side facing rubber strap 5. On the other sides (outer), carrier elements 4 have guide tracks 6 by which they are guided in a guiding slot 7 of the seatback frame 1. In this way, a simple height adjustment of the device can be made. The tension of membrane 2 ensures that guide tracks 6 cannot snap off.

Upholstery plate 9 along with cushion 8 and a plastic plate 10 are connected to each other via two clip connections. The clip connections 11 each are guided in guiding slots 12 of carrier elements 4 so that, in this manner, all three main components of the lumbar support are linked to each other. The guiding of clip connection 11 in guiding slots 12 makes it possible for upholstery plate 9 along with cushions 8 and the plastic plate 10 to be horizontally adjusted on carrier element 4.

This design ensures that the lumbar pad adjustment, like membrane 2, can yield if the user leans back and exerts pressure on the membrane. Rubber strap 5 yields and thus causes the carrier element to hen, which results in cushion 8 moving back.

The advantage of the present invention consists in particular of the fact that the strength of the action —the pressure—of the device can be matched exactly via the elasticity of the rubber strap and the thickness and density of the pad structure. The cushion can easily be replaced and an individualized preliminary tension can be realized by using different tensioning material.

Depicted in FIG. 3 is another design example. It is distinguished from the first design merely in that a guide track 13 is arranged on seatback frame 1 in the place of the guiding slot in seatback frame 1. Guide frames 8 of carrier elements 4 are guided along these guide tracks 13. The tension of menbrane 2 ensures that guide tracks 6 cannot snap out.

Naturally, the invention is not restricted to the described design example.

Reference Number List

1 seatback frame
2 membrane
3 membrane piping
4 carrier element
5 elastic element, e.g. rubber strap
6 guide frame of item 4
7 guiding track in item 1
8cushion
9 upholstery plate
10 plastic plate
11 clip connection
12 slot
13 guide frame of item 1

What is claimed is:

1. A device for lumbar support for an office chair having a seatback including a seatback frame with a membrane stretched over it, the device being arranged behind the membrane and housed in the seatback frame, wherein the device is adjustable in height and horizontally extendible independent from the membrane, is characterized in that it is made up of the following parts:

a) a central part having two rigid carrier elements, which are connected to each other via an elastic element arranged in the center and which on an outside have a guide track on each side, the guide tracks being arranged in the seatback frame with sliding adjustment, b) a cushion attached to an upholstery plate as a front part arranged facing the membrane, and c) a plastic plate as a rear part, whereby d) the cushion and the plastic plate are connected via a clip connection and the clip connection is guided in slots of the carrier element.

2. The device as recited in claim 1, characterized in that the elastic element is a rubber strap.

3. The device as recited in claim 1, characterized in that the guide tracks of the carrier elements are each arranged in a guiding slot of the seatback frame with sliding adjustment.

4. The device as recited in claim 1, characterized in that the guide tracks of carrier elements can be arranged on a guide stem of seatback frame with sliding adjustment.

5. A device for lumbar support for an office chair including a seatback having a seatback frame and a membrane stretched over the seatback frame, the device configured to be arranged behind the membrane and housed in the seatback frame to provide vertical and horizontal adjustment independent from the membrane, the device comprising:

a central part including two rigid carrier elements connected to each other via an elastic element arranged therebetween, the rigid carrier elements each including a guide configured to be arranged in the seatback frame to provide the vertical adjustment;

a front part including a cushion attached to an upholstery plate, the upholstery plate configured to face the membrane; and a rear part including a plastic plate, whereby the cushion and the plastic plate are connected via a clip connection, and the clip connection is guided in slots of the carrier elements.

6. The device as recited in claim 5, wherein the elastic element comprises a rubber strap.

7. The device as recited in claim 5, wherein the guides of the carrier elements are configured to be arranged in a guiding slot of the seatback frame to provide the vertical adjustment.

8. The device as recited in claim 5, wherein the guides of the carrier elements are configured to be arranged on a guide of the seatback frame to provide the vertical adjustment.

* * * * *